United States Patent [19]

Canale et al.

[11] 4,234,443

[45] Nov. 18, 1980

[54] COMPOSITION AND A METHOD USEFUL FOR MAKING A FOUNTAIN SOLUTION FOR LITHOGRAPHIC PRINTING OPERATIONS

[75] Inventors: Ralph D. Canale, Long Island City; Albert S. Canale, Bayside, both of N.Y.

[73] Assignee: Michael A. Canale, Long Island City, N.Y.

[21] Appl. No.: 890,018

[22] Filed: Mar. 24, 1978

[51] Int. Cl.[2] ..... C11D 3/08; C11D 7/16

[52] U.S. Cl. ..... 252/135; 252/140; 252/541; 252/DIG. 8; 252/DIG. 10; 252/174.15; 101/451

[58] Field of Search ..... 252/135, 140, 541, DIG. 8, 252/ DIG. 10, 174.15; 101/149.2

[56] References Cited

U.S. PATENT DOCUMENTS

| | | | |
|---|---|---|---|
| 3,312,624 | 4/1967 | Dupre et al. | 252/135 |
| 3,429,822 | 2/1969 | Grunewall et al. | 252/135 X |
| 3,843,558 | 10/1974 | Farminer et al. | 252/135 X |
| 3,933,672 | 1/1976 | Bartoloha et al. | 252/135 X |
| 4,005,030 | 1/1977 | Heckart et al. | 252/140 |
| 4,007,124 | 2/1977 | Collier et al. | 252/140 |

*Primary Examiner*—Mayer Weinblatt

*Attorney, Agent, or Firm*—Curtis, Morris & Safford

[57] ABSTRACT

This invention is directed to a composition useful for making a fountain solution for lithographic printing operations which comprises trisodium phosphate, sodium metasilicate, tetrapotassium pyrophosphate, a nonionic detergent which is a condensation product of ethylene oxide with a dialkylphenol, an alkylamine or an aliphatic alcohol, and dialkylpolysiloxane. The invention is further directed to a method for making such a fountain solution which comprises combining any of the compositions of the invention with water.

20 Claims, No Drawings

COMPOSITION AND A METHOD USEFUL FOR MAKING A FOUNTAIN SOLUTION FOR LITHOGRAPHIC PRINTING OPERATIONS

BACKGROUND OF THE INVENTION

1. Field of the Invention

The present invention relates to a dry powder formulation useful to make a fountain solution for use in lithographic printing operations and to a method of making a fountain solution from a dry powder formulation for use in lithographic printing. More particularly the invention relates to such a dry powder formulation which can be combined with water in situ to formulate a fountain solution concentrate or press ready fountain solution for lithographic printing applications.

2. Description of the Prior Art

In lithographic printing processes, such as in lithographic printing of newspapers, brochures and the like, fountain solutions are used in lithographic presses to replenish the desensitized area of lithographic plates, to clean the surface of the plates and to continuously keep the non-printing area of such plates water receptive or hydrophilic.

Prior to the present invention, fountain solutions were formulated which were acid based and included pure gum arabic, bichromate and phosphoric acid. These acid solutions had been used in the formulation of desensitizers or etches for stone lithography, zinc plate lithography and photo lithography on both zinc and aluminum. However, with the introduction of rotary lithographic sheet fed presses, the ability to feed ink and water in a continuous fashion to the surface of the plate led to the development of acid and gum treated solutions which would continuously replenish the desensitized area of the lithographic plate. Solutions of this type provided the ability to lithograph in a continuous and uninterrupted fashion. Drawbacks to using this type of formulation are the fact that bichromates link with phosphoric acid and gum to produce desensitizers which, while effective, are also capable of being absorbed and maintained in the human body and after sufficient absorption may produce serious skin rashes. In addition these types of fountain solutions had to be made up or mixed at each lithographic plant and hence there was the possibility of mistakes in the formulation which would effect the lithographic printing process.

More recently, alkali fountain solutions have been developed and have found wide commercial applicability for use in modern high speed newspaper web offset presses. These types of lithographic presses need fountain solutions without gum arabic or synthetic gums as desensitizers as the gums have a tendency in high speed operation to accumulate on the blankets and ink rollers and create a glaze condition on the ink rollers tending to cause the ink to strip from the ink rollers. The glaze accumulated on the blankets does not allow the ink image to transfer properly, creating a poor image on the printed sheet. In addition, when such presses are shut down, the lithographic plates must be gummed to prevent oxidation of the plates' surface during the shutdown period.

Other drawbacks to acid and gum fountain solutions reside in the fact that these gums cause the growth of algae and fungus mold which may accumulate in the pans and feed lines of the systems. Thus the alkali fountain solutions have been found to be most effective in high speed lithographic printing presses as these have a good replenishing action on the surface of the plate and constantly keep the non-printing area water receptive or hydrophilic.

The present invention relates to a new and unique formulation of a mixture of dry ingredients which may be shipped in bulk to the site of lithographic printing operations. At the printing site, the dry formulation of the present invention, when mixed with water in situ, produces an effective alkali fountain solution for lithographic printing press operation. Use of the dry powder formulation of the present invention with a predetermined quantity of water produces a lithographic fountain solution which is effective to replenish and renew the non-sensitized surface of a lithographic plate and maintain the non-printing area of lithographic printing plates water receptive or hydrophilic. In addition when used in lithographic printing presses the fountain solution produced by the present invention minimizes ink emulsification, eliminates roller stripping and cleans and maintains clean the entire water fountain system, pans, brushes, pumps and tanks of a lithographic press. In addition the fountain solution of the present invention prevents algae buildup or fungus mold from forming in pans or feed lines of the fountain system and greatly reduces linting and piling. In addition the fountain solution formed by the dry powder formulation of the present invention also eliminates the need to gum lithographic plates even on prolonged press shutdown.

The main constituent presently used in commercial lithographic fountain solutions is water. Thus shipment of such solutions to printing press sites is difficult as heavy drums of liquid solution must be shipped. These are bulky, difficult to handle and shipping costs are high. Accordingly, a further beneficial aspect of the dry powder formulation of the present invention resides in the fact that only dry powder in conveniently sized packages or cartridges must be handled and shipped. Thus use of the dry powder formulation for forming a lithographic fountain solution according to the present invention, results in significant cost savings and significantly easier handling in shipment of the dry powder fountain solution formulation. This is true because, the present invention provides a dry powder formulation for a lithographic fountain solution which may be shipped in bulk in its dry state with water, the major constituent by weight, being added at the site of the lithographic printing operation. Thus there is no need to ship large quantities of water which results in significant cost savings and greater ease in handling and shipping.

OBJECTS AND SUMMARY OF THE INVENTION

It is an object of the present invention to provide a dry powder formulation which when mixed with a predetermined quantity of water forms a lithographic fountain solution.

It is a further object of the present invention to provide a method of formulating a lithographic fountain solution from a dry powder formulation mixed in situ.

It is a still further object of the present invention to provide a dry powder formulation for a lithographic fountain solution which is effective to replenish desensitized areas of lithographic plates, clean the surface of lithographic plates and to continuously maintain the non-printing area of lithographic plates in a hydrophilic state.

A still further object of the present invention is to provide an effective dry powder formulation for a lithographic fountain solution which can be readily and conveniently packaged and shipped in an efficient and economical manner.

Yet another object of the present invention is to provide a dry powder formulation for a lithographic fountain solution which when mixed with a predetermined quantity of water forms a lithographic fountain solution which avoids many of the drawbacks of such fountain solutions used heretofore.

These and other aspects and advantages of the present invention will become more readily apparent after consideration of the following specification.

According to a preferred embodiment of the present invention, a dry powder mixture is formulated containing anhydrous trisodium phosphate, anhydrous sodium metasilicate, anhydrous tetrapotassium pyrophosphate, a non-ionic detergent and an anti-foaming agent. In a preferred embodiment this formulation is packaged in a thirty-five pound cartridge which is mixed at the lithographic printing press site with fifty-five gallons of water until all ingredients have completely dissolved to provide a lithographic fountain solution concentrate. The lithographic solution concentrate is further diluted with water in the lithographic operation to provide a "press ready" fountain solution.

The invention is directed to (1) a composition which comprises 2 to 66 percent by weight trisodium phosphate, 0.5 to 26.0 percent by weight sodium metasilicate, 2 to 67 percent by weight tetrapotassium pyrophosphate, 2 to 25 percent by weight of a nonionic detergent which is a condensation product of ethylene oxide with a dialkylphenol, an alkylamine or an aliphatic alcohol, and 0.02 to 10.00 percent by weight dialkylpolysiloxane; and (2) a method of forming a fountain solution for lithographic printing which comprises combining a composition as defined above with water.

DESCRIPTION OF PREFERRED EMBODIMENTS

In a preferred embodiment of the invention, the composition comprises 20 to 25 percent by weight trisodium phosphate, 12 to 17 percent by weight sodium metasilicate, 42 to 47 percent by weight tetrapotassium pyrophosphate, 15 to 20 percent by weight of a nonionic detergent which is a condensation product of ethylene oxide with a dialkylphenol, an alkylamine or an aliphatic alcohol, and 0.1 to 1.0 percent by weight dialkylpolysiloxane.

For purposes of this invention, the composition is most advantageously in the form of a free-flowing dry powder. This promotes convenient handling of the composition especially upon combination with water to form a fountain solution, the composition dissolving much more quickly when in the powder form than when in larger particle or granule sizes. However, while the most preferred physical embodiment of the composition of the invention is as a dry powder, it is herein expressly recognized that the size of the particles or granules of the composition of the invention does not effect the operability of the invention for the stated utility. Thus, although the composition, if in a powdered form, is more easily handled and dissolves more quickly when formed into a fountain solution by mixing with water, the invention is also directed to the above-described composition in the case that the granules of such composition are larger than powder particle size.

Although not essential to the practice of the invention, it is advantageous for purposes of promoting the uniformity of the performance of the composition of the invention under varying conditions of humidity and temperature and for purposes of promoting free flowability of the composition even after long periods of storage that the trisodium phosphate ($Na_3PO_4$), sodium metasilicate and tetrapotassium pyrophosphate ($K_4P_2O_7$) be anhydrous. This promotes one of the above-mentioned objects of the invention, to provide an effective dry powder formulation for a lithographic fountain solution which can be readily and conveniently packaged and shipped in an efficient and economical manner.

Anhydrous trisodium phosphate has a molecular weight of 163.97 and a typical screen analysis as follows:

| SCREEN ANALYSIS | Typical Analysis |
|---|---|
| Anhydrous, Powder | |
| Thru U.S. #20, % | 100 |
| Thru U.S. #100, % | 97 |
| Anhydrous, Granular | |
| Thru U.S. #20, % | 99 |
| Thru U.S. #100, % | 10 |

The solubility of anhydrous trisodium phosphate is 12 g./100 g. $H_2O$ at 20° C. and 30 g./100 g. $H_2O$ at 50° C.; the loose bulk density of anhydrous trisodium phosphate is 57 lb./ft.$^3$ in the powder form and 53 lb./ft.$^3$ in the granular form. Anhydrous sodium metasilicate has a typical screen analysis as follows:

| | | |
|---|---|---|
| Particle Sizing | Held on 10 mesh | 0.0% |
| | Through 65 mesh | 1.1% |
| | Through 100 mesh | 0.2% |

and an approximate bulk density of 72 lb./ft.$^3$. Anhydrous tetrapotassium pyrophosphate has a molecular weight of 330.34, a solubility of 191 g./100 g. $H_2O$ at 25° C., 207 g./100 g. $H_2O$ at 50° C. and 247 g./100 g. $H_2O$ at 75° C.; its loose bulk density is 60 lb./ft.$^3$ in powder form and 75 lb./ft.$^3$ in granular form.

Although it is recognized that either trisodium phosphate or tetrapotassium pyrophosphate may be reduced to merely trace amounts or even totally eliminated from a composition for forming a fountain solution for lithographic printing, such as the one herein claimed, without rendering the composition totally inoperative for purposes of lithographic printing, the overall performance, including sequestration, deflocculation (peptizing), emulsification, buffering and saponification of the fountain solution formed with the invention is so superior to performance when one or both of the above-mentioned phosphates are present in trace amount or eliminated that formulation of the composition in accordance with the present invention is highly advantageous to the stated utility of the invention.

The nonionic detergent of the invention is a compound formed by the condensation of a dialkylphenol, an alkylamine or an aliphatic alcohol with a sufficient amount of ethylene oxide to produce a compound with the desired surface active, wetting, emulsifying and detergent properties. Either one nonionic detergent compound or a mixture of different nonionic detergent compounds may be used in the composition of the invention. Although there are many detergents of this type available, those which are particularly useful in this invention, and therefore preferred, are those produced by the condensation of ethylene oxide with a dialkylphenol, an alkylamine, or an aliphatic alcohol in a molar ratio of from 9:1 to 150:1 (ethylene oxide: dialkylphenol, alkylamine or alcohol). A molar ratio of 15:1 to 150:1 is especially preferred. Furthermore, detergents formed by the condensation of ethylene oxide and a dialkylphenol, the dialkyl moiety of which is of from 2 to 20 carbon atoms or a primary aliphatic alcohol of from 12 to 20 carbon atoms, according to the above-mentioned preferred molar ratios have been found to be particularly useful.

In connection with the foregoing, an especially preferred embodiment is a composition wherein a nonionic detergent formed by the condensation of from 9 to 150, especially 15 to 150, moles of ethylene oxide with one mole of dialkylphenol, the dialkyl moiety being of from 2 to 20 carbon atoms, or a primary aliphatic alcohol of from about 12 to 20 carbon atoms is included.

According to a specific embodiment of the present invention, the nonionic detergent included in the claimed composition is an ethoxylated straight chain primary aliphatic alcohol of the formula $$R—O—(CH_2—CH_2—O)_{16}—H,$$

wherein R is of from 12 to 20 carbon atoms, or a combination of such alcohols. Such a detergent is produced by BASF Wyandotte Corporation, and is distributed under the name Plurafac A-38.

While the detergent described in the preceding paragraph is the most preferred detergent for the purposes of this invention, an acceptable alternative is a nonionic detergent distributed under the name Igepal DM-970, produced by Dow Chemical Company, and having the formula

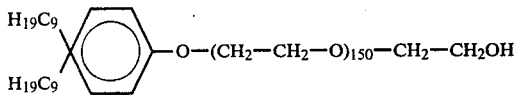

Dialkyl polysiloxane is included in the composition of the present invention to prevent excessive foaming in the ultimately formed fountain solution. It is advantageously incorporated in the composition of the present invention by spraying a solution of this agent on to a dry powder mixture of trisodium phosphate, sodium metasilicate, tetrapotassium pyrophosphate and a nonionic detergent, but can be added by other means, for example, by gently pouring on the mixed powders. One commercially available solution which is useful in the present invention is DOW CORNING Antifoam B Emulsion. This Emulsion typically contains 10 percent active defoamer (dialkyl polysiloxane) in the form of a silicone and water emulsion. At 77° F., this Emulsion generally has the consistency of a light cream, a specific gravity of 1.003 and a pH of 6.5.

In another embodiment of the invention, the composition comprises a mixture consisting essentially of 22.22 percent by weight trisodium phosphate, 14.81 percent by weight sodium metasilicate, 44.45 percent by weight tetrapotassium pyrophosphate, 18.52 percent by weight of a nonionic detergent which is a condensation product of ethylene oxide with a dialkylphenol, an alkylamine, or an aliphatic alcohol; and 0.65 pounds of dialkyl polysiloxane per 100 pounds of said mixture.

In a specific embodiment of the invention, the composition comprises a mixture consisting essentially of 22.22 percent by weight trisodium phosphate, 14.81 percent by weight sodium metasilicate, 44.45 percent by weight tetrapotassium pyrophosphate, 18.52 percent by weight of a nonionic detergent which is an ethoxylated straight chain primary aliphatic alcohol of the formula $$R—O—(CH_2—CH_2—O)_{16}—H,$$

wherein R is of from 12 to 20 carbon atoms, or a combination of such alcohols; and 0.65 pounds of dialkylpolysiloxane per 100 pounds of said mixture.

The invention is also directed to a method for forming a fountain solution for lithographic printing which comprises combining any of the previously described compositions of the invention with water.

For purposes of the invention, it is sufficient that the water with which the composition of the invention is combined be locally-obtained, cold water. This is highly advantageous as the use of local water under conditions which are particular to each different location at which the invention is practiced promotes complete uniformity of every batch of fountain solution made in accordance with the invention. Of course, in some areas the metallic and mineral content of the local water, in combination with alkali, can cause the formation of sedimentary particles. However, to avoid this undesireable formation of sedimentary particles, water softeners can be included in the composition of the invention. This eliminates the need for de-ionizers and other extensive and expensive water treatments.

In a preferred embodiment of the method of the invention, a fountain solution for lithographic printing is formed by combining a composition wherein the nonionic detergent is formed by condensing ethylene oxide with a dialkylphenol the dialkyl moiety of which is of from 2 to 20 carbon atoms, or a primary aliphatic alcohol of from 12 to 20 carbon atoms, in a molar ratio of ethylene oxide to dialkylphenol or primary aliphatic alcohol of from 9:1 to 150:1, especially of from 15:1 to 150:1.

An especially preferred embodiment of the method of the invention comprises combining about 55 gallons of water with about 6.6 ounces of a composition comprising a mixture consisting essentially of 22.2 percent by weight anhydrous trisodium phosphate, 14.81 percent by weight anhydrous sodium metasilicate, 44.45 percent by weight anhydrous tetrapotassium pyrophosphate, 18.52 percent by weight of a nonionic detergent which is an ethoxylated straight chain primary aliphatic alcohol of the formula $$R—O—(CH_2—CH_2—O)_{16}—H,$$

wherein R is of from 12 to 20 carbon atoms, or a combination of such alcohols; and 0.65 pounds of dialkylpolysiloxane per 100 pounds of said mixture. The fountain solution produced by this method is a press-ready fountain solution made directly from the composition of the invention, which may be employed without further dilution in a lithographic printing operation.

However, in order to be compatible with existing systems for working up dilute fountain solutions from concentrates instead of a dry composition, about 35 pounds of the composition of the invention may be mixed with about 55 gallons of water to produce a concentrated fountain solution. This concentrate can then be appropriately diluted with water to a press-ready fountain solution by adding about 1.5 liquid ounces of concentrate to each approximately 1 gallon of water used.

The pH of the press-ready fountain solution is approximately 9.5.

EXAMPLE 1

200 pounds of anhydrous trisodium phosphate, 133.25 pounds of anhydrous sodium metasilicate, 400 pounds of anhydrous tetrapotassium pyrophosphate and 166.75 pounds of Plurafac A-38, all in powdered form, were placed in a hopper which was equipped with an auger extending upward from the bottom of the hopper. The auger was rotated and the various powders were transported up the auger in such a manner that the powders were mixed with one another. When the powders reached the top of the auger, they were thrown off and allowed to fall back into the hopper. At the point where the powders were thrown off from the top of the auger, a solution of DOW CORNING Antifoam B Emulsion was gently poured into the stream of falling powders. The auger was rotated in this manner until the powders were thoroughly mixed and three quarts of the Antifoam B Emulsion had been combined with the powders.

The batch of composition thus obtained was approximately 900 pounds in weight.

EXAMPLE 2

Thirty-five pounds of the composition formed as described in Example 1 are poured into a 55-gallon specially-lined mixing drum containing 55 gallons of water which has been introduced into the drum through a side entry filling port. Prior to introduction of the powder the water is agitated by an internally-mounted motor driven mixing unit and the composition and the water are mixed by the mixing unit. the composition is completely mixed with the water in less than 15 minutes.

Fifty-five gallons of a working concentrate of the composition of Example 1 in water are obtained. This concentrate is diluted with water in a ratio of 1.5 liquid ounces of this working concentrate for each gallon of water used to obtain a press-ready fountain solution containing approximately 6.6 ounces of the composition of Example 1. The press-ready solution has a pH of 9.5.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

What is claimed is:

1. A composition adapted for use in a fountain solution which consists essentially of 2 to 66 percent by weight trisodium phosphate; 0.5 to 26.0 percent by weight sodium metasilicate; 2 to 67 percent by weight tetrapotassium pyrophosphate; 2 to 25 percent by weight of a nonionic detergent selected from the group consisting of condensation products of ethylene oxide with dialkylphenols, the dialkyl moieties which are of from 2 to 20 carbon atoms, and of ethylene oxide with monohydric hydrocarbon alcohols of from 12 to 20 carbon atoms, the molar ratio of ethylene oxide units to each dialkylphenol unit or monohydric hydrocarbon alcohol unit in each said condensation product being of from 9:1 to 150:1; and 0.02 to 10.00 percent by weight dialkylpolysiloxane.

2. The composition as defined in claim 1, wherein the trisodium phosphate, sodium metasilicate and tetrapotassium pyrophosphate are anhydrous.

3. The composition as defined in claim 1, wherein the composition is a dry powder.

4. The composition defined in claim 1, wherein said molar ratio is of from 15:1 to 150:1.

5. The composition as defined in claim 1, wherein the nonionic detergent is an ethoxylated straight chain alcohol of the formula $$R—O—(CH_2—CH_2—O)_{16}—H,$$

wherein R is hydrocarbon of from 12 to 20 carbon atoms, or the nonionic detergent is a combination of such alcohols.

6. A composition as defined in claim 1, which consists essentially of 20 to 25 percent by weight trisodium phosphate; 12 to 17 percent by weight sodium metasilicate; 42 to 47 percent by weight tetrapotassium pyrophosphate; 15 to 20 percent by weight of said nonionic detergent; and 0.1 to 1.0 percent by weight dialkylpolysiloxane.

7. A composition as defined in claim 6, which consists essentially of a mixture of 22.22 percent by weight trisodium phosphate; 14.81 percent by weight sodium metasilicate; 44.45 percent by weight tetrapotassium pyrophosphate; and 18.52 percent by weight of said nonionic detergent; and 0.65 pounds of dialkylpolysiloxane per 100 pounds of said mixture.

8. A composition adapted for use in a fountain solution which consists essentially of 2 to 66 percent by weight trisodium phosphate; 0.5 to 26.0 percent by weight sodium metasilicate; 2 to 67 percent by weight tetrapotassium pyrophosphate; 2 to 25 percent by weight of a nonionic detergent which is a compound of the formula

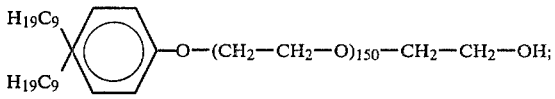

and 0.2 to 10.00 percent by weight dialkylpolysiloxane.

9. A concentrate adapted for use in a fountain solution, which consists essentially of water and a composition consisting essentially of 2 to 66 percent by weight trisodium phosphate; 0.5 to 26.0 percent by weight sodium metasilicate; 2 to 67 percent by weight tetrapotassium pyrophosphate; 2 to 25 percent by weight of a nonionic detergent selected from the group consisting of condensation products of ethylene oxide with dialkylphenols, the dialkyl moities of which are of from 2 to 20 carbon atoms, and condensation products of ethylene oxide with monohydric hydrocarbon alcohols of from 12 to 20 carbon atoms, the molar ratio of ethylene oxide units to each dialkylphenol unit or monohydric hydrocarbon alcohol unit in each said condensation product being of from 9:1 to 150:1; and 0.02 to 10.00 percent by weight dialkylpolysiloxane.

10. A concentrate as defined in claim 9, which consists essentially of water and a composition consisting essentially of a mixture of 22.22 percent by weight trisodium phosphate, 14.81 percent by weight sodium metasilicate, 44.45 percent by weight tetrapotassium pyrophosphate and 18.52 percent by weight of said nonionic detergent, and 0.65 pounds of dialkylpolysiloxane per 100 pounds of said mixture.

11. The concentrate as defined in claim 9, wherein said molar ratio is of from 15:1 to 150:1.

12. The concentrate as defined in claim 9, wherein the composition and water are present in a ratio of about 35 pounds of said composition to 55 gallons of water.

13. The concentrate as defined in claim 9, wherein the nonionic detergent is selected from the group consisting of ethoxylated straight chain alcohols of the formula $$R—O—(CH_2—CH_2—O)_{16}—H$$

wherein R is hydrocarbon of from 12 to 20 carbon atoms, and mixtures thereof.

14. A concentrate adapted for use in a fountain solution and which consists essentially of water and a composition consisting essentially of 2 to 66 percent by weight trisodium phosphate; 0.5 to 26.0 percent by weight sodium metasilicate; 2 to 67 percent by weight tetrapotassium pyrophosphate; 2 to 25 percent by weight of a nonionic detergent which is a compound of the formula

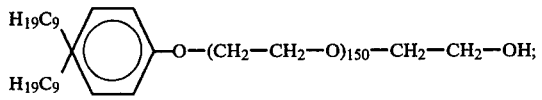

and 0.02 to 10.00 percent by weight dialkylpolysiloxane.

15. A fountain solution which consists essentially of water and an effective amount of a composition consisting essentially of 2 to 66 percent by weight trisodium phosphate; 0.5 to 26.0 percent by weight sodium metasilicate; 2 to 67 percent by weight tetrapotassium pyrophosphate; 2 to 25 percent by weight of a nonionic detergent selected from the group consisting of condensation products of ethylene oxide with dialkylphenols, the dialkyl moieties of which are of from 2 to 20 carbon atoms, and condensation products of ethylene oxide with monohydric hydrocarbon alcohols of from 12 to 20 carbon atoms, the molar ratio of ethylene oxide units to each dialkylphenol unit or monohydric hydrocarbon alcohol unit in each said condensation product being of from 9:1 to 150:1; and 0.02 to 10.00 percent by weight dialkylpolysiloxane.

16. A fountain solution as defined in claim 15, which consists essentially of water and an effective amount of a composition consisting essentially of a mixture of 22.22 percent by weight trisodium phosphate, 14.81 percent by weight sodium metasilicate, 44.45 percent by weight tetrapotassium pyrophosphate, and 18.52 percent by weight of said nonionic detergent, and 0.65 pounds of dialkylpolysiloxane per 100 pounds of said mixture.

17. The fountain solution as defined in claim 15, wherein said molar ratio is of from 15:1 to 150:1.

18. The fountain solution as defined in claim 15, wherein the composition and water are present in a ratio of about 6.6 ounces of the composition to 55 gallons of water.

19. The fountain solution as defined in claim 15, wherein the nonionic detergent is selected from the group consisting of ethoxylated straight chain alcohols of the formula $$R—O—(CH_2—CH_2—O)_{16}—H$$

wherein R is hydrocarbon of from 12 to 20 carbon atoms, and mixtures thereof.

20. A fountain solution which consists essentially of water and an effective amount of a composition consisting essentially of 2 to 66 percent by weight trisodium phosphate; 0.5 to 26.0 percent by weight sodium metasilicate; 2 to 67 percent by weight tetrapotassium pyrophosphate; 2 to 25 percent by weight of a nonionic detergent which is a compound of the formula

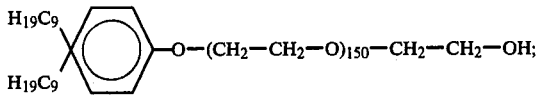

and 0.2 to 10.00 percent by weight dialkylpolysiloxane.

* * * * *

UNITED STATES PATENT AND TRADEMARK OFFICE

CERTIFICATE OF CORRECTION

PATENT NO. : 4,234,443

DATED : November 18, 1980

INVENTOR(S) : Ralph D. Canale, et al

It is certified that error appears in the above-identified patent and that said Letters Patent is hereby corrected as shown below:

TITLE PAGE:

In the Heading, Item [75], the list of inventors "Ralph D. Canale, Long Island City; Albert S. Canale, both of N.Y." should be --Ralph D. Canale, Long Island City; Albert S. Canale, Massapequa; and Harry Papazian, Long Island City, all of N.Y.--.

Column 2, lines 41 and 43, in both instances, the comma (,) should not appear.

Column 5, line 11, after "atoms" there should be a comma (,); line 13, after "ratios" there should be a comma (,); line 46, "Dialkyl polysiloxane" should be --Dialkylpolysiloxane--; line 58, "dialkyl polysiloxane" should be --dialkylpolysiloxane--.

Column 6, line 31, "undesireable" should be --undesirable--.

Column 7, line 16, "upward" should be --upwardly--; line 39, "the" should be --The--.

Signed and Sealed this

Sixth Day of July, 1993

Michael K. Kirk

*Attest:*

MICHAEL K. KIRK

*Attesting Officer*

*Acting Commissioner of Patents and Trademarks*